US005120255A

United States Patent [19]

Kouda et al.

[11] Patent Number: 5,120,255

[45] Date of Patent: Jun. 9, 1992

[54] COMPLETE LOCKING CONFIRMING DEVICE FOR CONFIRMING THE COMPLETE LOCKING OF AN ELECTRIC CONNECTOR

[75] Inventors: Tomoyuki Kouda; Kazuto Ohtaka; Takashi Ishii; Mitsuru Matsumoto; Shigemi Hashizawa; Yoshinori Hiraguchi, all of Shizuoka, Japan

[73] Assignee: Yazaki Corporation, Tokyo, Japan

[21] Appl. No.: 659,652

[22] Filed: Feb. 25, 1991

[30] Foreign Application Priority Data

Mar. 1, 1990 [JP] Japan ..... 2-47174
Mar. 28, 1990 [JP] Japan ..... 2-76749
Oct. 2, 1990 [JP] Japan ..... 2-263075

[51] Int. Cl.[5] ..... H01R 3/00
[52] U.S. Cl. ..... 439/489
[58] Field of Search ..... 439/345, 347, 350, 351, 439/352, 353, 354, 355, 357, 488, 489, 358

[56] References Cited

U.S. PATENT DOCUMENTS 4,711,507 12/1987 Noorily ..... 439/347 X
4,746,306 5/1988 Yurtin et al. ..... 439/357
4,902,244 2/1990 Endo et al. ..... 439/489
4,925,402 5/1990 Inaba et al. ..... 439/490
4,946,395 8/1990 Cope et al. ..... 439/489 X
4,946,404 8/1990 Takenouchi et al. ..... 439/352
4,950,179 8/1990 Takenouchi et al. ..... 439/352
4,984,998 1/1991 Ducan et al. ..... 439/352

*Primary Examiner*—Larry I. Schwartz
*Assistant Examiner*—Khiem Nguyen
*Attorney, Agent, or Firm*—Armstrong, Nikaido, Marmelstein, Kubovcik & Murray

[57] ABSTRACT

A complete locking confirming device for an electric connector comprising a first connector having a first connector housing, a second connector having a second connector housing capable of being coupled with the first connector housing, and locking means provided in combination with the first and second connector housings to lock the electric connector when the first and second connectors are coupled completely. The complete locking confirming device comprises a complete locking detecting slider mounted on either of the first connector housing and the second connector housing so as to be positioned at a complete locking indicating position only when the first and second connectors are coupled completely and the electric connector is locked by the locking means. The complete locking detecting slider is provided with a complete locking indicating mark, which is located opposite to and can be read by a mark reader only when the complete locking detecting slider is located at the complete locking indicating position.

7 Claims, 17 Drawing Sheets

COMPLETE LOCKING CONFIRMING DEVICE FOR CONFIRMING THE COMPLETE LOCKING OF AN ELECTRIC CONNECTOR

BACKGROUND OF THE INVENTION

1. Field of the Invention

The present invention relates to an electric connector provided with a complete locking confirming device, for connecting conductors of a wire harness to those of another wire harness or to those of an electric equipment.

2. Description of the Prior Art

In connecting conductors by an electric connector, the male and female connector housings of the electric connector are coupled, and the male and female connector housings are locked by a locking mechanism to prevent the separation of the male and female connector housings so that the electrical connection of the conductors can be secured. When the male and female connector housings of an electric connector are coupled automatically on an automated production line, such as an automobile production line, by means of an industrial robot or the like, it is necessary to inspect the electric connector to see if the male and female connector housings are coupled completely.

Japanese Pat. Laid-open No. 63-225480 discloses means for detecting the condition of the coupled male and female connector housings of an electric connector as shown in FIG. 15. This means matchmarks the male connector housing a and the female connector housing b of an electric connector respectively with marks $c_1$ and $c_2$, which constitute a matchmark c when the male connector housing a and the female connector housing b are coupled completely, reads the matchmark c with an optical mark reader d to see if the male connector housing a and the female connector housing b are coupled completely. If either the male connector housing a or the female connector housing b is attached directly to an electrical equipment, such as an instrument panel, an automotive radio set or a junction box, it is difficult to provide a counter matchmark on the connector housing directly attached to the electrical equipment.

FIGS. 16 and 17 shows another conventional device for confirming the complete locking of an electric connector. This electric connector comprises a female connector housing 1, accommodating terminals, not shown, a male connector housing 2 accommodating terminals, not shown, a locking finger 3 having a locking hook 4, a latch gate 5, and a locking member 6 to be inserted in the space between the upper wall of the male housing 2 and the locking finger 3 for locking.

When the female connector housing 1 and the male connector housing 2 are not coupled completely, the locking hook 4 is depressed by the latch gate 5, so that the locking member 6 cannot be inserted in the space between the upper wall of the male housing 2 and the locking finger 3. However, if the locking member 6 is passed under the latch gate 5 before the male connector housing 2 is coupled with the female connector housing 1, the hooks 7 of the locking member 6 engage the latch gate 5. In such a case it is very difficult to remove the locking member 6 from the male connector housing 2.

SUMMARY OF THE INVENTION

Accordingly, it is a first object of the present invention to provide a complete locking confirming device for an electric connector, capable of confirming the complete locking of the electric connector regardless of the type of the electric connector.

A second object of the present invention is to provide a complete locking confirming device for an electric connector, capable of indicating the complete locking of the electric connector only when the electric connector is completely locked.

In one aspect of the present invention, a complete locking confirming device for an electric connector comprising a male connector housing, a female connector housing, and locking means that is able to engage when the male and female connector housings are coupled completely, comprises a complete locking detecting slider capable of engaging at least either the male connector housing or the female connector housing only when the male and female connector housings are coupled completely, and provided with a mark which can be read by a mark reader when the complete locking detecting slider engages either the male connector housing or the female connector housing.

In another aspect of the present invention, a complete locking confirming device for an electric connector comprising a male connector housing, a female connector housing, an elastically bendable locking finger having a locking projection and formed on the wall of the male (or female) connector housing, a latch formed on the wall of the female (or male) connector housing so as to engage the locking projections of the locking fingers to lock the electric connector when the male and female connector housings are coupled completely, comprising a complete locking detecting slider having a complete locking detecting finger provided at its free end with a stopping projection, and a sliding body, and slidably fitted in a guide way formed between the locking fingers, and is characterized in that the stopping projection of the complete locking detecting finger comes into abutment with the locking projections of the locking fingers, and the complete locking detecting finger is held by the locking fingers when the electric connector is not locked by the locking fingers, and the complete locking detecting slider is able to advance to its complete locking indicating position when the electric connector is locked by the locking fingers.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

Figure 1:
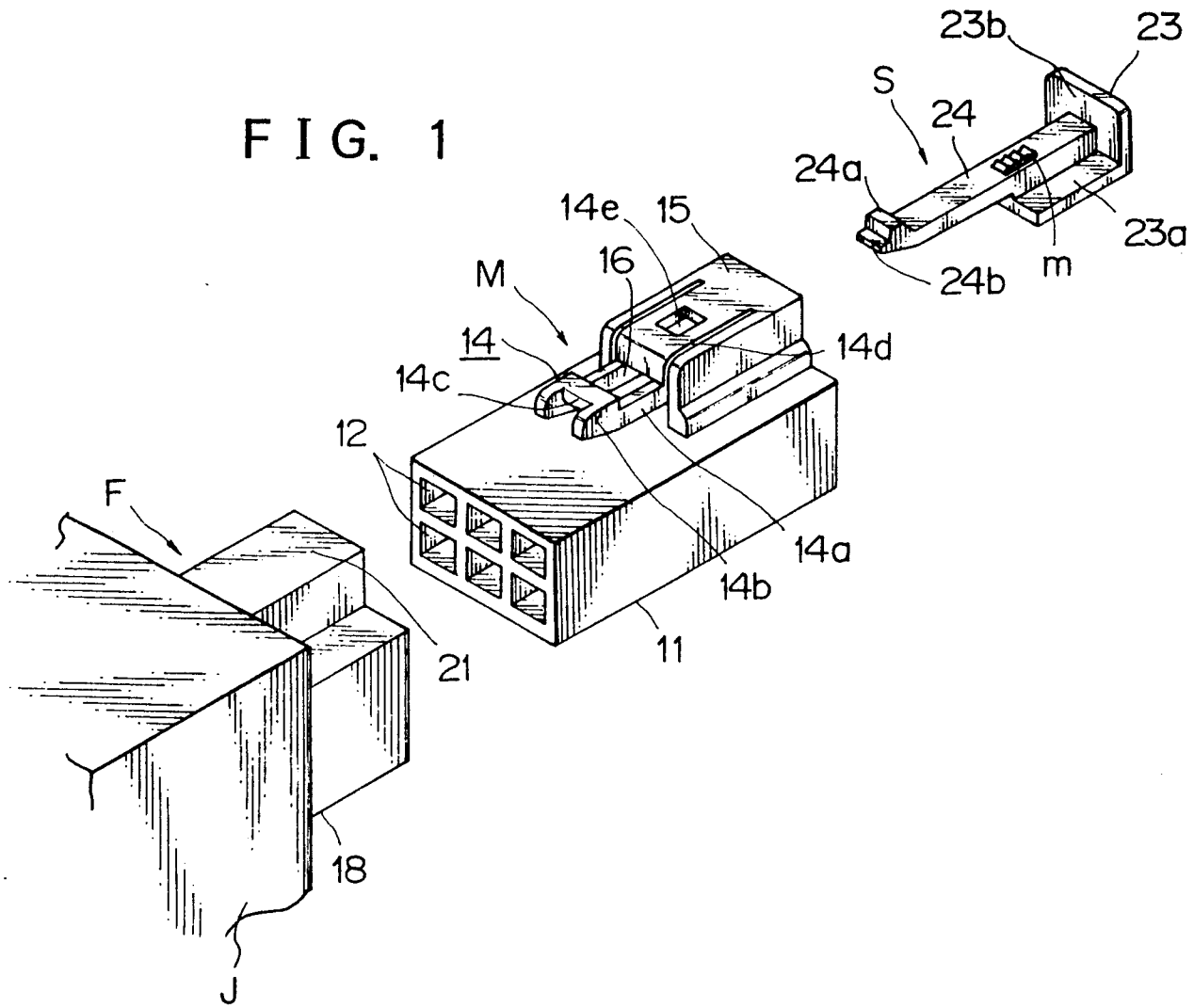
FIG. 1 is an exploded perspective view of an electric connector incorporating a complete locking confirming device in a first embodiment according to the present invention.
Figure 2:
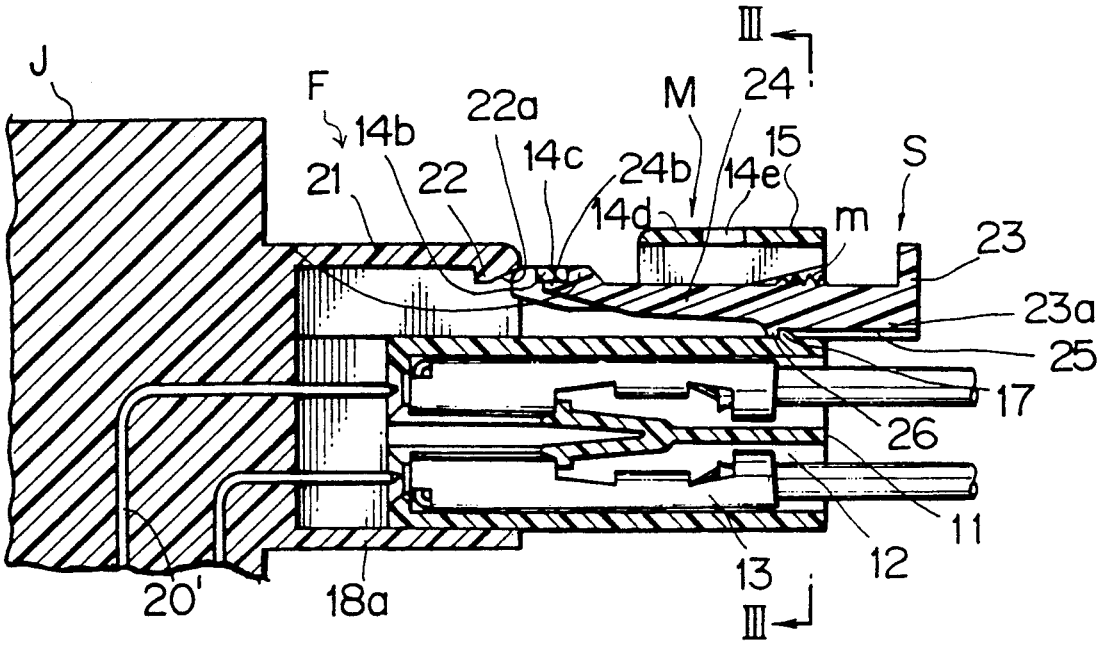
FIG. 2 is a sectional view of the electric connector of FIG. 1 in a half connected state.
Figure 3:
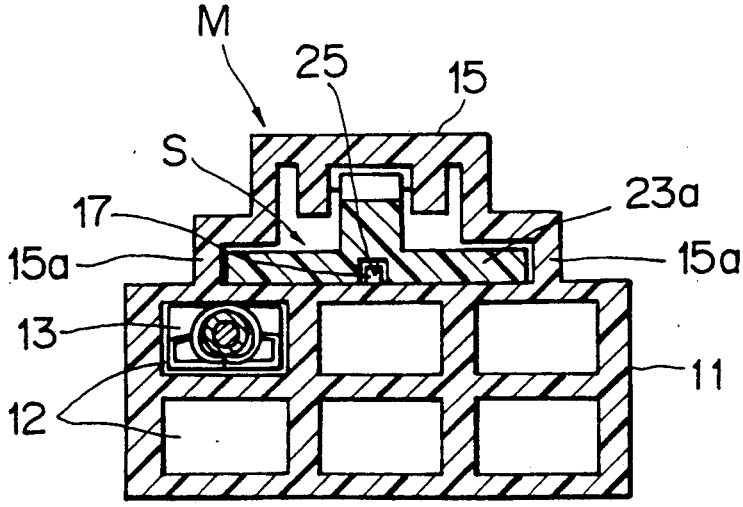
FIG. 3 is a sectional view taken on line III—III in FIG. 2.

Referring to FIGS. 1 to 3, there are shown a male connector M, a female connector F and a complete locking detecting slider S. The female connector F is attached directly to a junction box J. The male connector M has a male connector housing 11 internally provided with a plurality of terminal chambers 12 arranged in two banks and respectively accommodating female terminals 13 as shown in FIG. 2. A locker 14 is formed on the upper surface of the upper wall of the male connector housing 11. The locker 14 consists of a gate 15, a pair of flexible locking fingers 14a extending to the front from the gate 15 and provided at their extremities respectively with locking projections 14b, and a cross bar 14c interconnecting the locking projections 14b. An opening 14e is formed in the upper wall 14d of the gate 15. A guide way 16 is defined by the pair of locking fingers 14a and the side walls 15a of the gate 15. A stopping projection 17 is formed on the upper surface of the upper wall of the male connector housing 11 between the side walls 15a of the gate 15 as shown in FIG. 2.

As best shown in FIG. 2, the female connector F attached to the junction box J has a female connector housing 18 provided with terminal chambers accommodating male terminals 20' so as to correspond respectively to the female terminals 13 of the male connector M. The male terminals 20' extend directly from a circuit board, not shown, provided in the junction box J. A hood 18a for receiving the male connector M is formed in the front half of the female connector housing 18. A portion of the upper wall of the hood 18a is bulged to form a locking chamber 21 for receiving the locking fingers 14a. A latching projection 22 is formed in the inner surface of the upper wall of the locking chamber 21. The latching projection 22 is tapered toward the front to form a guide surface 22a to guide the locking projections 14b of the locking fingers 14a.

A complete locking detecting slider S consists of a slider body 23 having an L-shaped cross section, and a complete locking detecting finger 24. The slider body 23 has a sliding plate 23a and an operating plate 23b. A guide groove 25 is formed in the lower surface of the sliding plate 23a at a position corresponding to the projection 17, and a projection 26 is formed at the front end of the guide groove 25 as shown in FIG. 2. The detecting finger 24 is provided at its free end with a projection 24a and a nose 24b extending to the front from the projection 24a. A complete locking indicating mark m is formed in the central area of the upper surface of the detecting finger 24. The mark m may be of any kind provided that the mark m can be identified by a known mark reader, such as ridges and furrows, a bar code or a colored symbol. Preferably, the mark m indicates also the specification, the number of poles and the like.

A complete locking confirming device including the complete locking detecting slider S, and the function of the same will be described hereinafter with reference to FIGS. 4a to 4f.

The complete locking detecting slider S is combined beforehand with the male connector M as shown in FIG. 2 by inserting the complete locking detecting slider S in a space between the upper wall of the male connector housing 11 and the gate 15 so that the complete locking detecting finger 24 advances along the guide way 16 until the projection 24a comes into contact with the cross bar 14c, the nose 24b supports the cross bar 14c and the projection 26 of the sliding plate 23a rides over the stopping projection 17 of the upper wall of the male connector housing 11. Thus, the complete locking detecting slider S is retained on the male connector housing 11, and the complete locking detecting finger 24 is held by the locker 14.

Figure 4A:
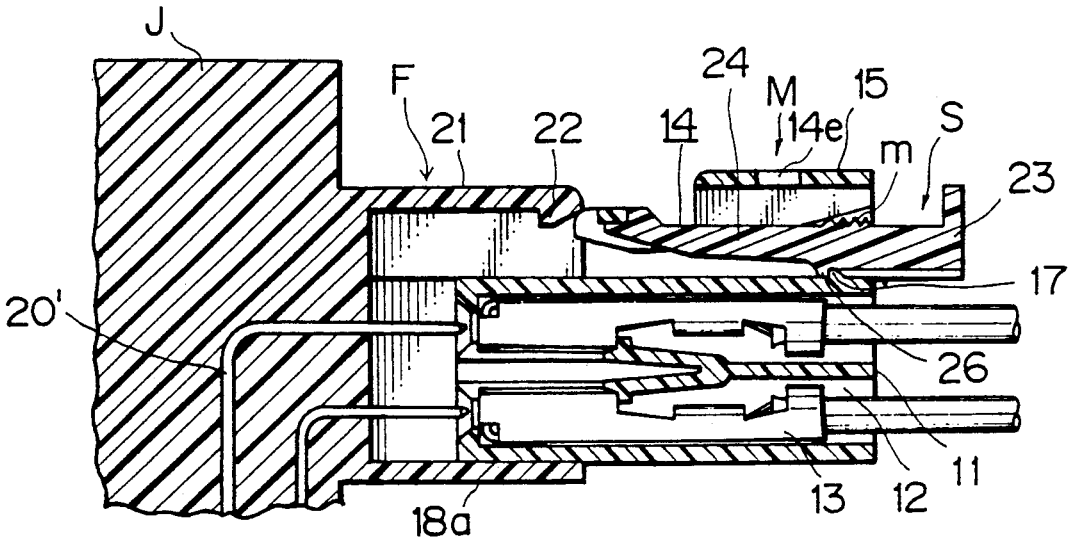
FIGS. 4*a*, 4*b*, 4*c*, 4*d*, 4*e*, 4*f* are sectional views of the essential portion of the electric connector of FIG. 1 in different stages of connection.

In FIG. 4a, the male connector M holding the complete locking detecting slider S is half fitted in the hood 18a of the female connector F with the locking projections 14b of the locker 14 in abutment with the latching projection 22 of the locking chamber 21. Since the complete locking detecting slider S is not fully inserted in the locker 14 in the state shown in FIG. 4a, the mark m cannot be seen through the opening 14e.

Figure 4B:
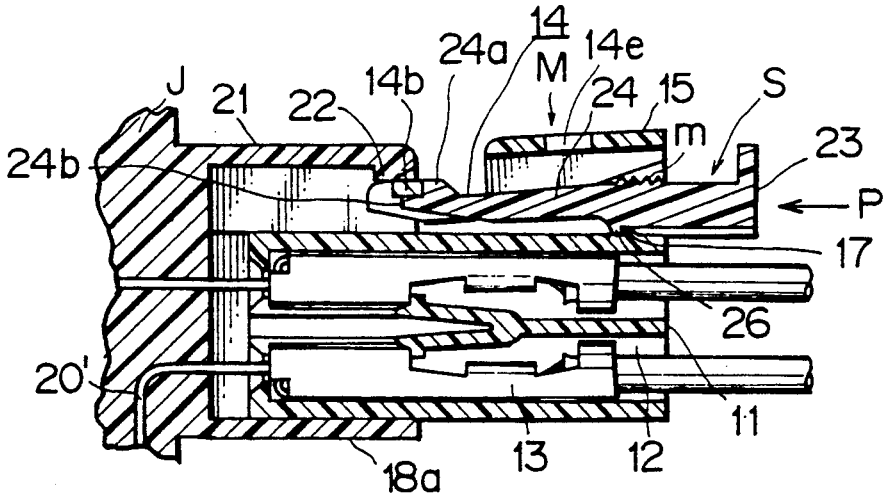
Figure 4C:
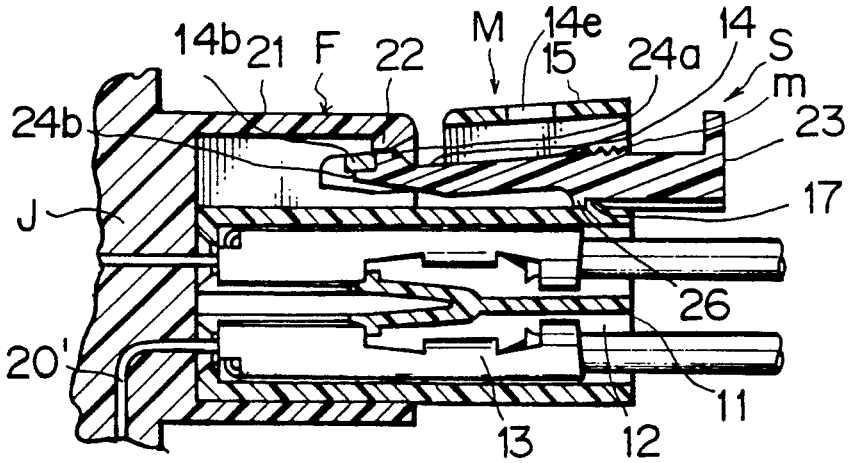

Then, the male connector M is pushed together with the complete locking detecting slider S in the direction of an arrow P, the locking projections 14b slide along the guide surface 22a of the latching projection 22, bending the locking fingers 14a and the complete locking detecting finger 24 downward as shown in FIGS. 4b and 4c. Since the projection 24a and nose 24b of the detecting finger 24 are in contact with the cross bar 14c of the locker 14, the detecting finger 24 is bent down and the projection 24a passes under the latching projection 22.

Figure 4D:
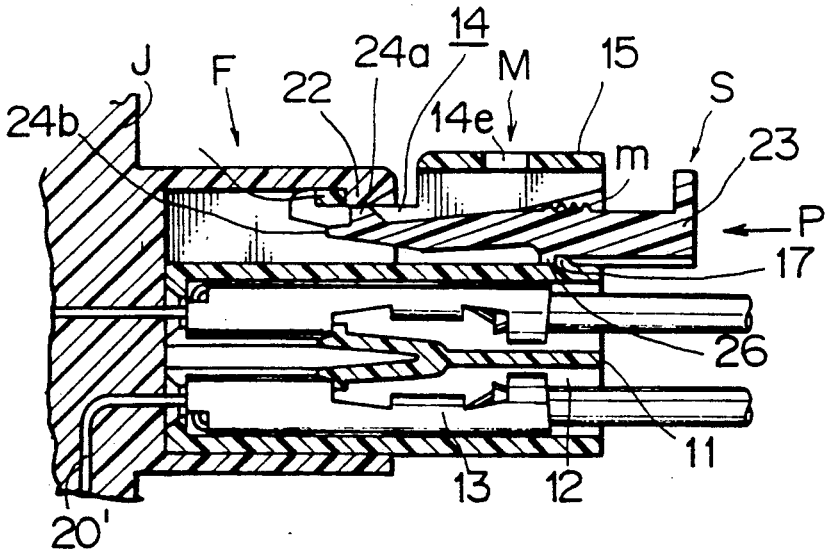
Figure 4E:
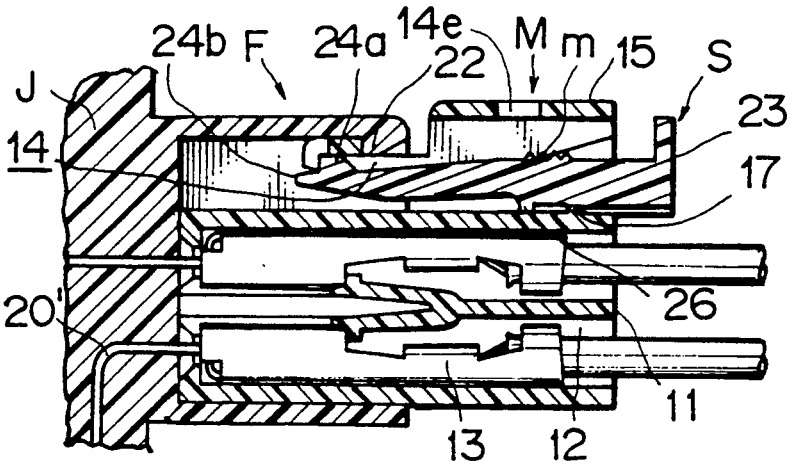
Figure 4F:
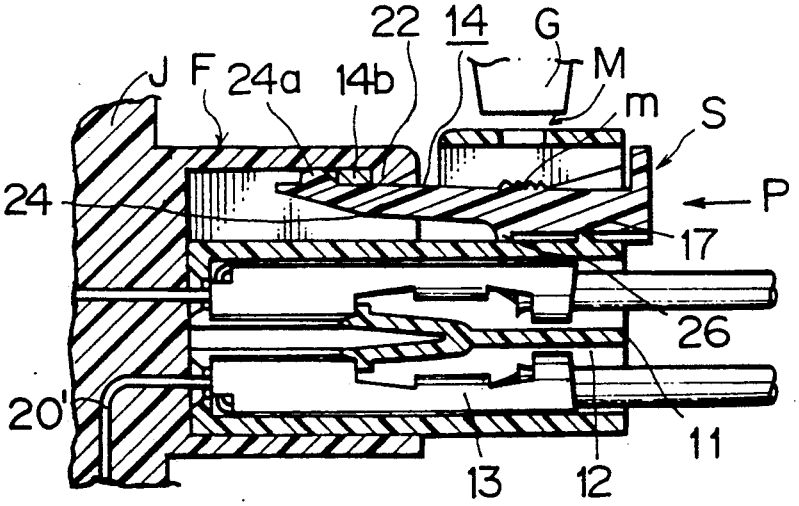

As the male connector M is pushed further into the female connector housing 18 from a position shown in FIG. 4c to a position shown in FIG. 4d, the cross bar 14c is positioned behind the latching projection 22 and, consequently, the locking fingers 14a of the locker 14 are allowed to recover their basic forms elastically and the cross bar 14c engages the latching projection 22.

Thus the male connector M and the female connector F are coupled completely and the electric connector is locked. In this state, the female terminals 13 and the male terminals 20' are in complete electrical connection. When the locking fingers 14*a* are allowed to recover their basic forms, the cross bar 14*c* is disengaged from the projection 24*a* to allow the complete locking detecting slider S to advance further toward the female connector F. When the complete locking detecting slider S is pushed further from a position shown in FIG. 4*e* to a complete locking indicating position shown in FIG. 4*f*, the projection 24*a* is positioned behind the cross bar 14*c* to allow the detecting finger 24 to recover its basic form elastically. In this state, the mark m provided on the complete locking detecting finger 24 is located directly below the opening 14*e* of the locker 14.

Thus, the complete locking detecting slider S is allowed to be positioned at the complete locking indicating position to indicate the complete locking of the electric connector only when the male connector M and the female connector F are coupled completely, the electric connector is locked and the projection 24*a* of the detecting finger 24 is disengaged from the cross bar 14*c* of the locker 14.

The mark m of the complete locking detecting slider S is read through the opening 14*e* of the locker 14 and recorded by a mark reader G for the automatic detection and recording of the complete locking of the electric connector instead of visual detection. The record can be reserved.

The mark reader G may be of a conventional type. Generally, the mark reader G comprises a light source, such as a LED, for illuminating the mark m, an optical sensor for detecting light reflected by the mark m, a computer for comparing information provided by the optical sensor and reference information previously stored in a memory included therein, and an output means for recording and/or displaying the result of comparison of the information provided by the optical sensor and the reference information. Thus, the complete coupling of the male connector M and the female connector F, and the complete locking of the electric connector are confirmed by reading the mark m of the complete locking detecting slider S.

The nose 24*b* that engages the cross bar 14*c* of the locker 14 may be omitted. As is obvious from FIGS. 4*b* to 4*d*, when the nose 24*b* is omitted, the complete locking detecting finger 24 is bent after the locking fingers 14*a* of the locker 14 have been bent, so that the complete locking detecting slider S can be pushed by a reduced force.

Naturally, the female connector F need not necessarily be attached to the junction box J; the present invention is applicable to an electric connector having an ordinary free male connector and an ordinary free female connectors.

In an electric connector having a female connector provided on its female connector housing with the locker 14, and a male connector provided on its male connector housing with a latching gate, a complete locking detecting slider S is advanced through the latching gate toward the female connector.

Second Embodiment

Figure 5:
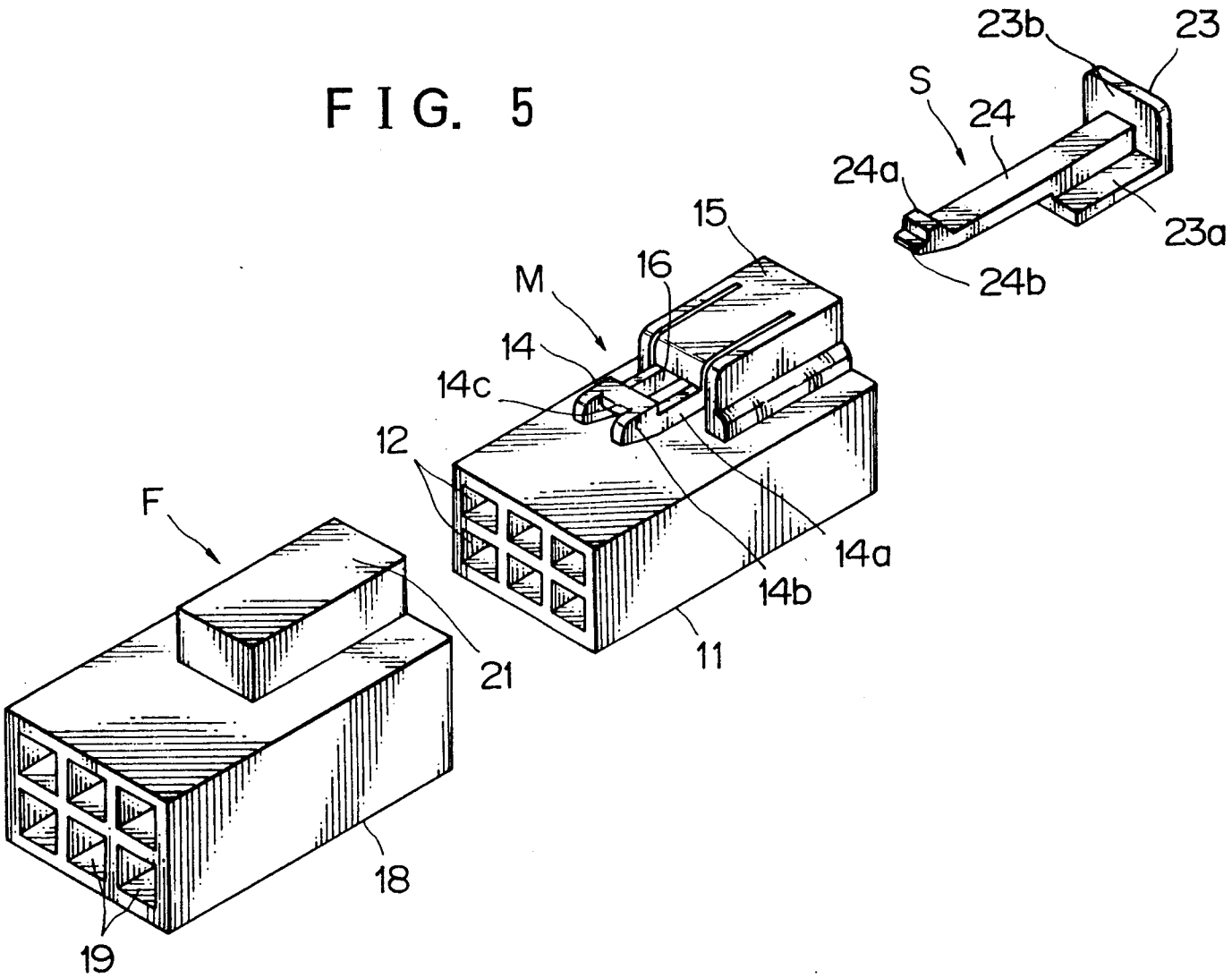
FIG. 5 is an exploded perspective view of an electric connector incorporating a complete locking confirming device in a second embodiment according to the present invention.
Figure 6:
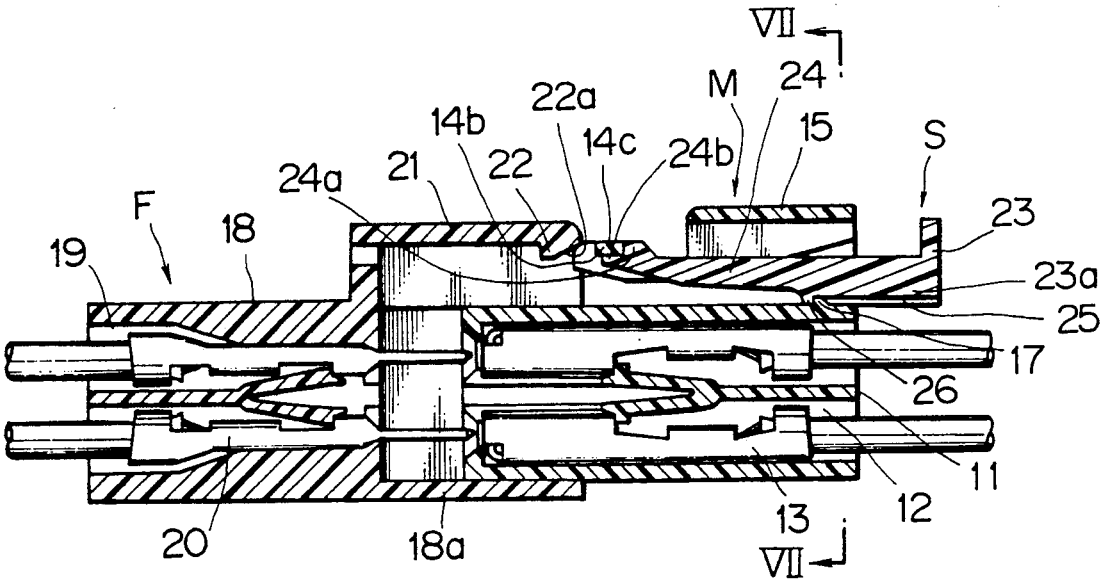
FIG. 6 is a sectional view of the electric connector in a half connected state.
Figure 7:
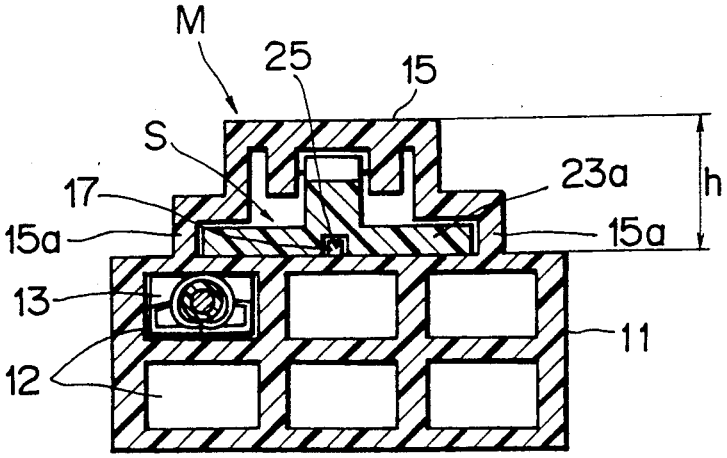
FIG. 7 is a sectional view taken on line VII—VII in FIG. 6.

Referring to FIGS. 5 to 7, there are shown a male connector M, a female connector F and a complete locking detecting slider S. The male connector M has a male connector housing 11 internally provided with a plurality of terminal chambers 12 arranged in two banks and respectively accommodating female terminals 13 as shown in FIG. 6. A locker 14 is formed on the upper surface of the upper wall of the male connector housing 11. The locker 14 consists of a gate 15, a pair of flexible locking fingers 14*a* extending to the front from the gate 15 and provided at their extremities respectively with locking projections 14*b*, and a cross bar 14*c* interconnecting the locking projections 14*b*. A guide way 16 is defined by the pair of locking fingers 14*a* and the side walls 15*a* of the gate 15. A stopping projection 17 is formed on the upper surface of the upper wall of the male connector housing 11 between the side walls 15*a* of the gate 15 as shown in FIGS. 6 and 7.

As best shown in FIG. 6, the female connector F has a female connector housing 18 provided with a plurality of terminal chambers accommodating male terminals 20 so as to correspond respectively to the female terminals 13 of the male connector M. A hood 18*a* for receiving the male connector M is formed in the front half of the female connector housing 18. A portion of the upper wall of the hood 18*a* is bulged to form a locking chamber 21 for receiving the locking fingers 14*a* of the locker 14. A latching projection 22 is formed in the inner surface of the upper wall of the locking chamber 21. The latching projection 22 is tapered toward the front to form a guide surface 22*a* to guide the locking projections 14*b* of the locking finger 14*a*.

A complete locking detecting slider S consists of a slider body 23 having an L-shaped cross section, and a complete locking detecting finger 24. The slider body 23 has a sliding plate 23*a* and an operating plate 23*b*. A guide groove 25 is formed in the lower surface of the sliding plate 23*a* at a position corresponding to the projection 17, and a projection 26 is formed at the front end of the guide groove 25 as shown in FIGS. 6 and 7. The detecting finger 24 is provided at its free end with a projection 24*a* and a nose 24*b* extending to the front from the projection 24*a*.

The function of the complete locking detecting slider S will be described hereinafter with reference to FIGS. 8*a* to 8*f*.

The complete locking detecting slider S is combined with the male connector M as shown in FIG. 6 by inserting the complete locking detecting slider S in a space between the upper wall of the male connector housing 11 and the gate 15 so that the complete locking detecting finger 24 advances along the guide way 16 until the vertical, front surface of the projection 24*a* comes into contact with the cross bar 14*c*, the nose 24*b* supports the cross bar 14*c* and the projection 26 of the sliding plate 23*a* rides over the stopping projection 17 of the upper wall of the male connector housing 11. Thus, the complete locking detecting slider is retained on the male connector housing 11, and the complete locking detecting finger 24 is held by the locker 14.

In FIG. 4*a*, the male connector M holding the complete locking detecting slider S is half fitted in the hood 18*a* of the female connector F with the locking projections 14*b* of the locker 14 in abutment with the latching projection 22 of the locking chamber 21.

Figure 8A:
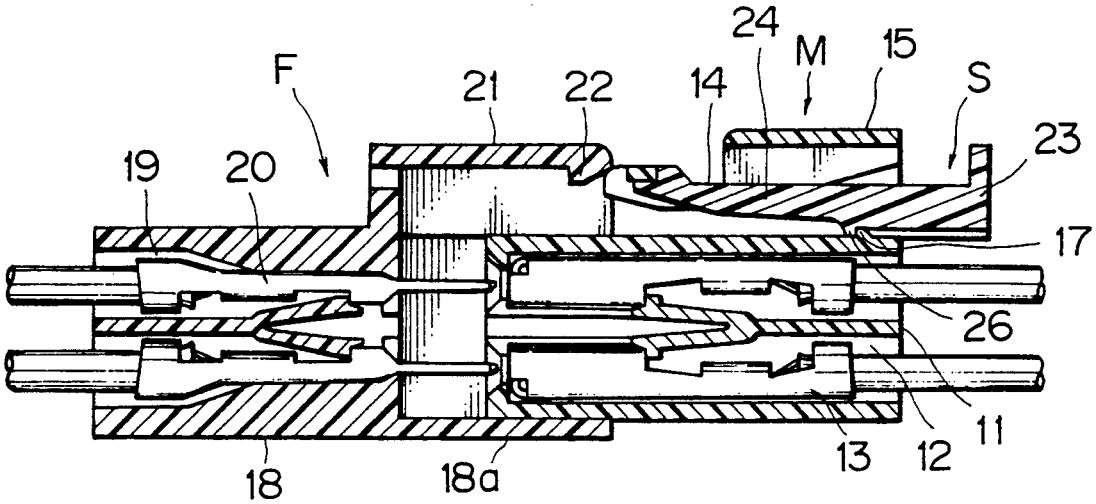
FIGS. 8a, 8b, 8c, 8d, 8e, 8f are sectional views of the essential portion of the electric connector of FIG. 5 in different stages of connection.
Figure 8B:
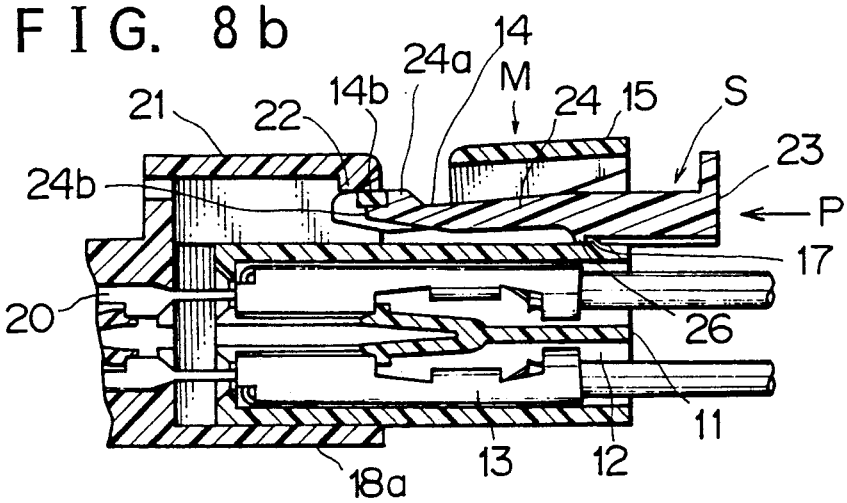
Figure 8C:
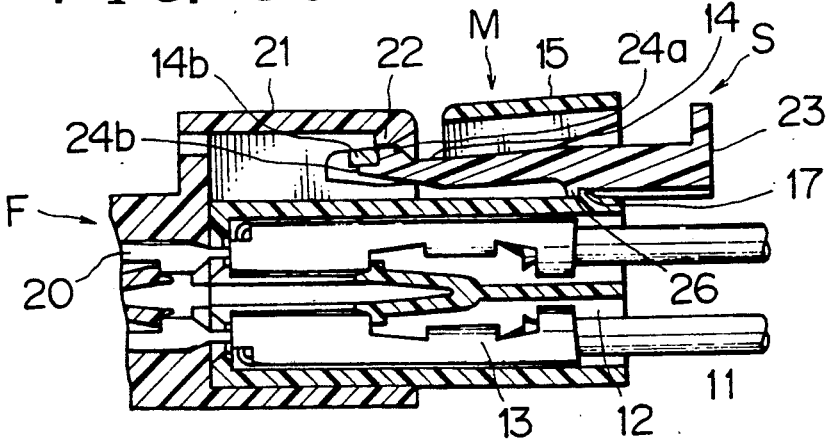
Figure 8D:
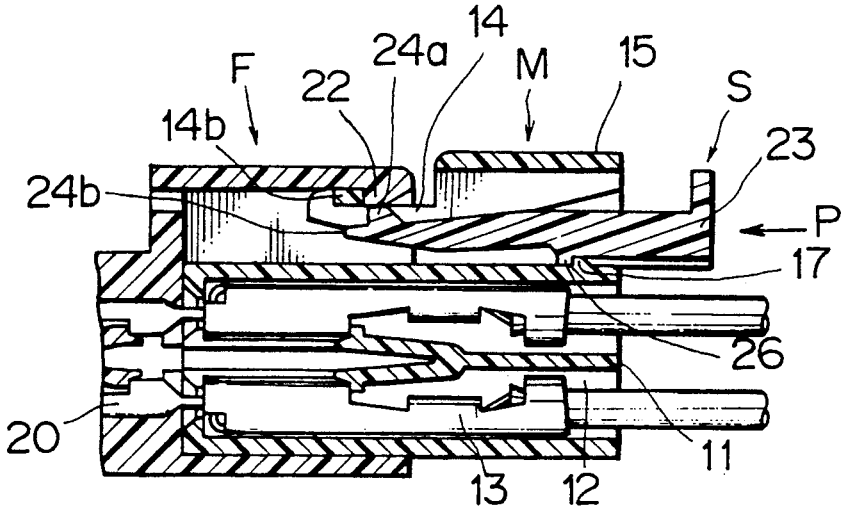
Figure 8E:
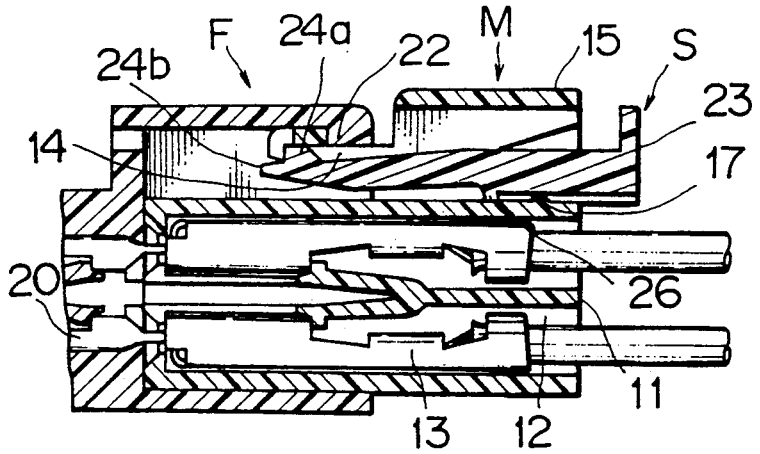
Figure 8F:
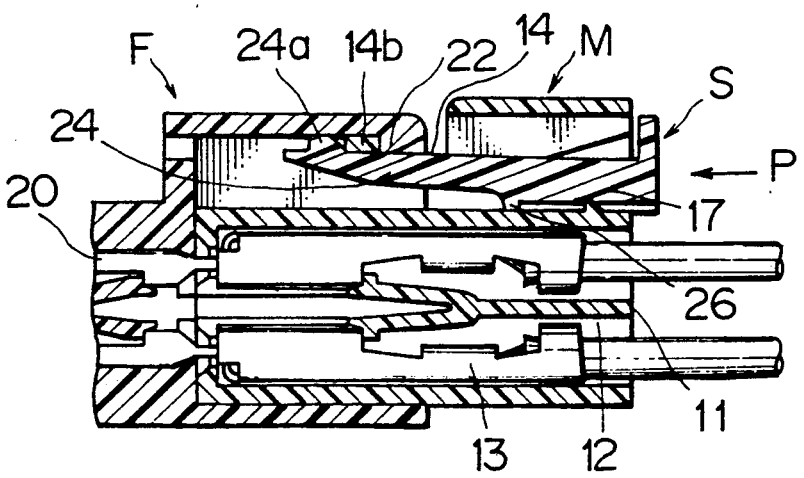

Then, the male connector M is pushed together with the complete locking detecting slider S in the direction of an arrow P, the locking projections 14*b* slide along the guide surface 22*a* of the latching projection 22, bending the locking fingers 14*a* and the complete locking detecting finger 24 downward as shown in FIGS. 8*b* and 8*c*. Since the projections 24*a* and nose 24*b* of the detecting finger 24 are in contact with the cross bar 14c of the locker 14, the detecting finger is bent down and the projection 24a passes under the latching projection 22. As the male connector M is pushed further into the female connector housing 18 from a position shown in FIG. 8c to a position shown in FIG. 8d, the cross bar 14c is positioned behind the latching projection 22 and, consequently, the locking fingers 14a of the locker 14 are allowed to recover their basic forms elastically and the cross bar 14c engages the latching projection 22. thus, the male connector M and the female connector F are coupled completely and the electric connector is locked. In this state, the female terminals 13 and the male terminals 20 are in complete electrical connection. When the locking fingers 14a are allowed to recover their basic forms, the cross bar 14c is disengaged from the projection 24a to allow the complete locking detecting slider S to advance further toward the female connector F. When the complete locking detecting slider S is pushed further from a position shown in FIG. 8e to a position shown in FIG. 8f, the projection 24a is positioned behind the cross bar 14c to allow the detecting finger 24 to recover its basic form elastically. In this state, the complete locking detecting slider S is positioned at a complete locking indicating position shown in FIG. 8f.

Thus, the complete locking detecting slider S is allowed to be positioned at the complete locking indicating position to indicate the complete locking of the electric connector only when the male connector M and the female connector F are coupled completely, the electric connector is locked and the projection 24a of the detecting finger 24 is disengaged from the cross bar 14c of the locker 14.

Third Embodiment

Figure 9:
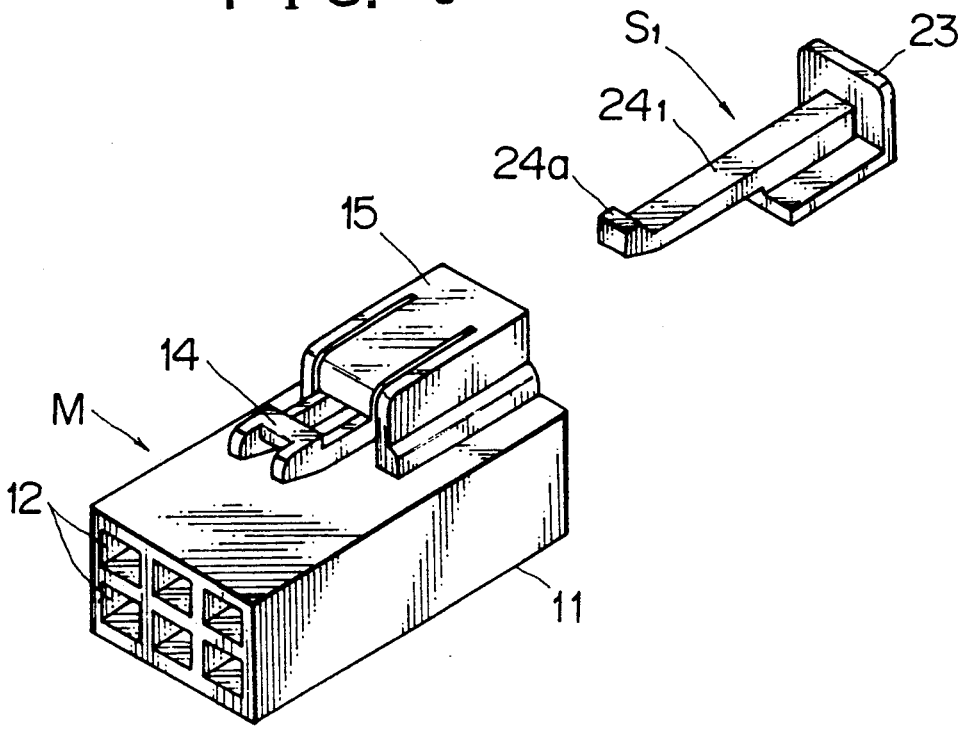
FIG. 9 is a perspective view of an essential portion of an electric connector incorporating a complete locking confirming device in a third embodiment according to the present invention.

An electric connector incorporating a complete locking confirming device in a third embodiment according to the present invention shown in FIG. 9 is substantially the same in construction as the electric connector in the second embodiment shown in FIG. 5, except that the complete locking detecting finger $24_1$ of the complete locking detecting slider $S_1$ in the second embodiment is not provided with any portion like the nose 24b of the perfect locking detecting finger 24 of the complete locking detecting slider S employed in the first embodiment.

As is obvious from FIG. 8b, the perfect locking detecting finger $24_1$ is not bent down by the locking fingers 14a. The perfect locking detecting finger $24_1$ bends down as the projection 24a advances along the guide surface 22a of the latching projection 22 (FIG. 6), and the perfect locking detecting slider $S_1$ advances from a position shown in FIG. 8b through positions shown in FIGS. 8c to 8d to a perfect locking indicating position shown in FIG. 8f. Since the perfect locking detecting finger $24_1$ is bent after the locking fingers 14a of the locker 14 have been bent, the perfect locking detecting slider $S_1$ can be pushed by a reduced force.

Fourth Embodiment

Figure 10:
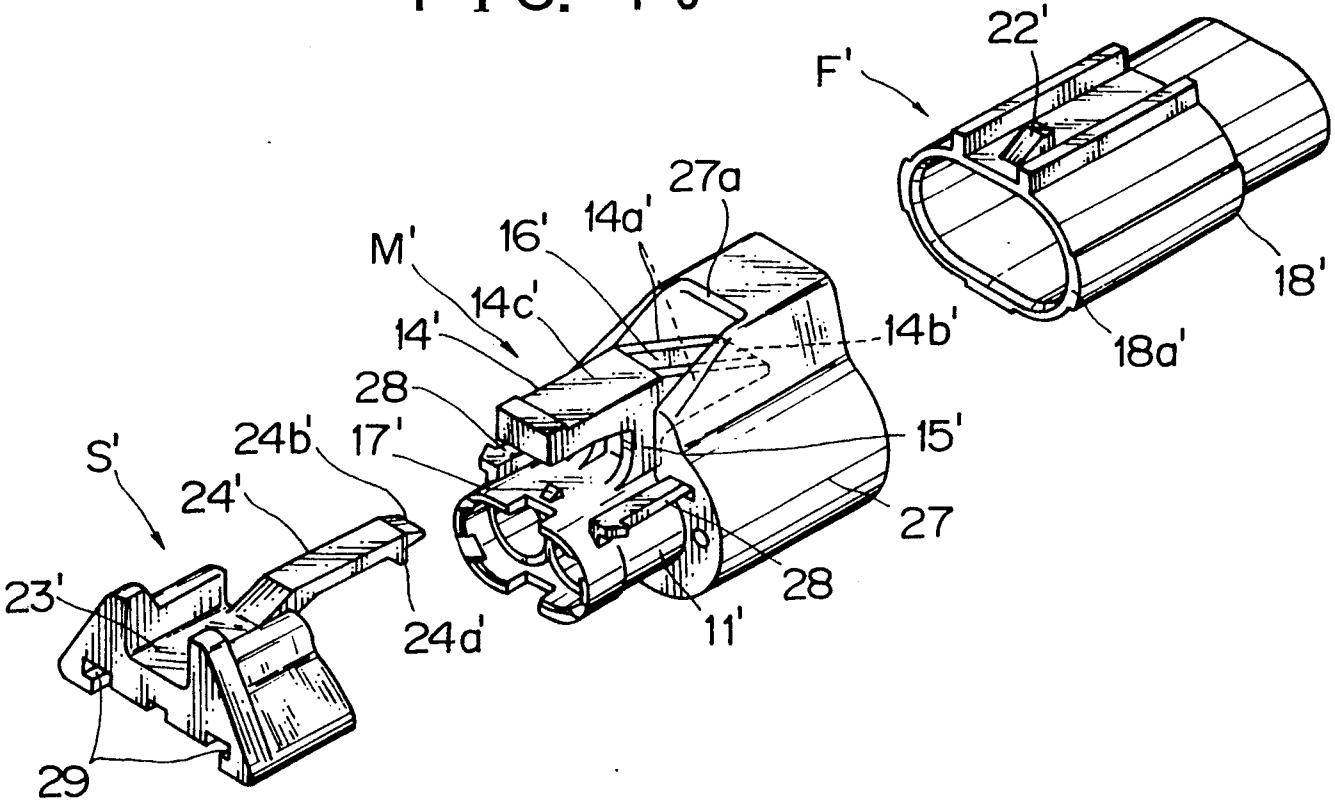
FIG. 10 is a perspective view of an electric connector incorporating a complete locking confirming device in a fourth embodiment according to the present invention.

Referring to FIG. 10, an electric connector incorporating a complete locking confirming device in a fourth embodiment according to the present invention is a waterproof electric connector. The electric connector has a male connector M' having a male connector housing 11' of an elliptic cross section, and a female connector F' having a female connector housing 18' of a shape conforming to that of the male connector housing 11', and a hood 18a'. A waterproof hood 27 for covering the hood 18a' of the female connector housing 18' is formed in the front half portion of the male connector housing 11'.

An opening 27a is formed in the upper portion of the waterproof hood 27, and a locker 14' having a gate 15' is formed on the upper surface of the male connector housing 11' so as to extend through the opening 27a. The locker 14' has a pair of locking fingers 14a' extending to the front from the gate 15', a cross bar 14b' interconnecting the extremities of the locking fingers 14a', and a knob portion 14c' extending to the rear from the gate 15'. The locking fingers 14a' are tapered to the front in the shape of a triangle. A guide way 16' is defined by the locking fingers 14a'.

The male connector housing 11' is provided on the outer circumference of its rear portion with a projection 17' at the top center of the circumference, and guides 28 for guiding a complete locking detecting slider S' on the opposite sides of the projection 17'. A latching projection 22' is formed on the hood 18a' of the female connector F' so as to engage the cross bar 14b' of the locker 14.

The complete locking detecting slider S' consists of a slider body 23' and a complete locking detecting finger 24' extending slightly upward from the slider body 23'. A projection 24a' is formed on the lower surface of the extremity of the complete locking detecting finger 24', and a nose 24b' projects beyond the projection 24a'. The slider body 23' is provided on its lower surface with a guide groove 25' in the central portion of the lower surface, a projection 26' at the front end of the guide groove 25' (FIG. 11), and guide grooves 29 on the opposite sides of the guide groove 25'. Alternatively, the guide groove 29 may be formed in the outer circumference of the male connector housing 11', and the guides 28 may be formed on the slider body 23'.

The complete locking detecting slider S' is mounted on the male connector M' with the guide grooves 29 engaging the guides 28, the projection 26' of the slider body 23' engages the projection 17' so that the complete locking detecting slider S' is retained on the male connector M', and with the projection 24a' of the locking finger 24' inserted in the guide way 16' of the locker 14 in abutment with the cross bar 14b'.

FIGS. 11a to 11f show the electric connector at different stages in coupling the male connector M' retaining the complete locking detecting slider S', and the female connector F'.

Figure 11A:
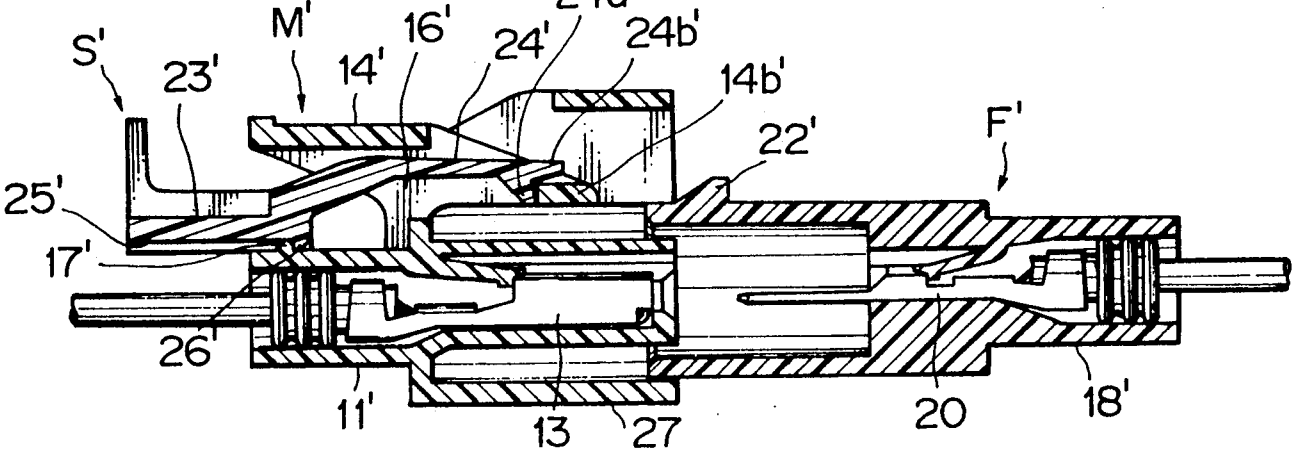
FIGS. 11a, 11b, 11c, 11d, 11e, 11f are sectional views of an essential portion of the electric connector of FIG. 10 in different stages of connection.
Figure 11B:
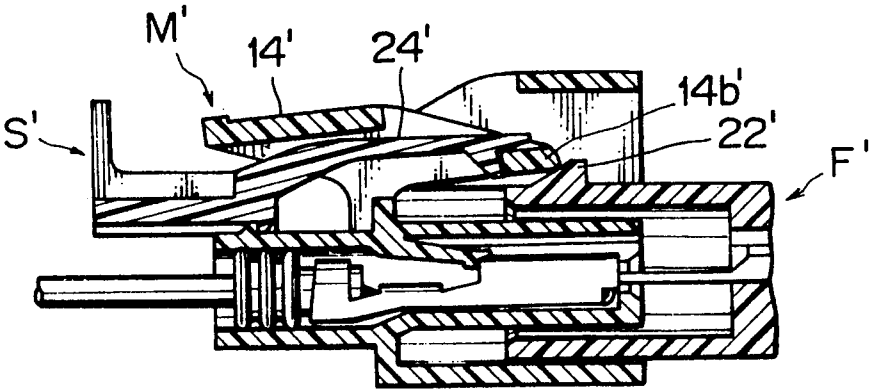
Figure 11C:
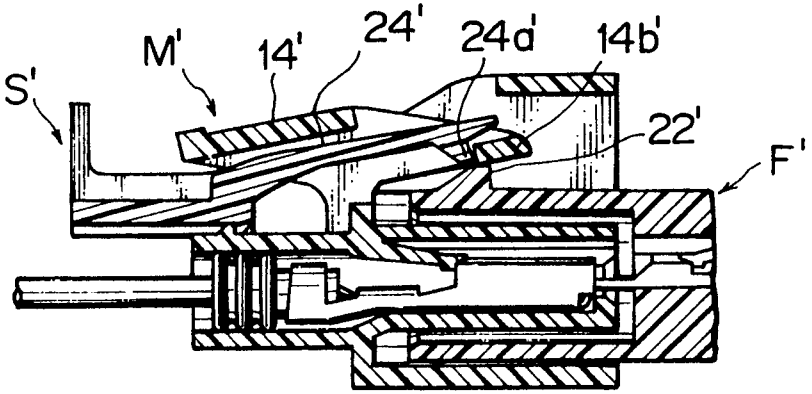
Figure 11D:
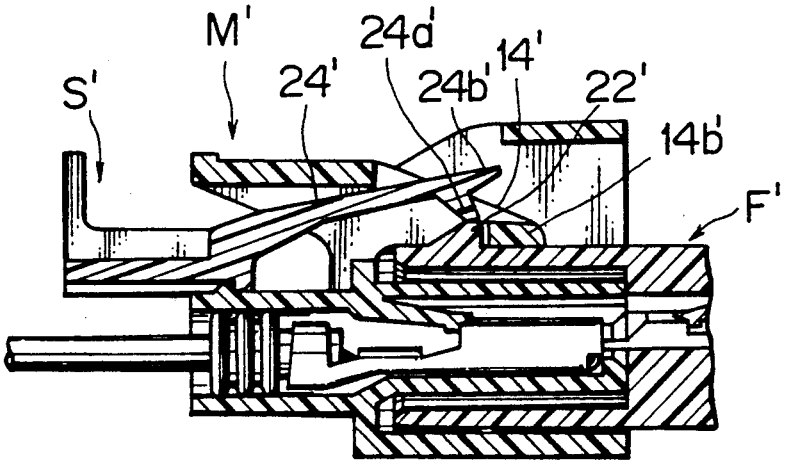
Figure 11E:
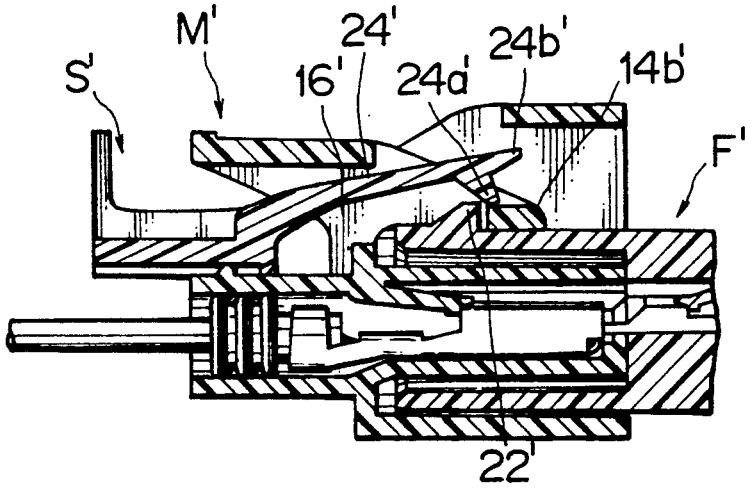
Figure 11F:
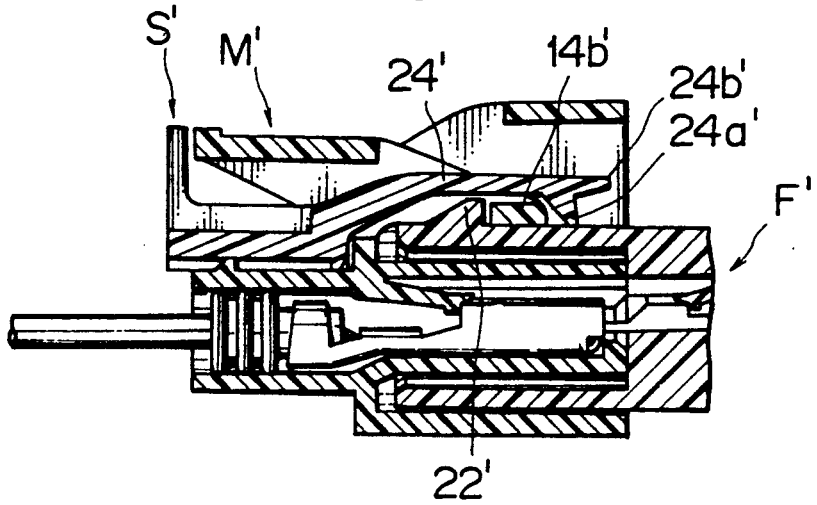

In the stages of coupling the male connector M' and the female connector F' shown in FIGS. 11a to 11c, the locking fingers 14a' of the locker 14 bend up as the cross bar 14b' of the locker 14' climbs up the latching projection 22'. In a stage shown in FIG. 11d, the cross bar 14b' rides over the latching projection 22' to allow the locking fingers 14a' to recover their basic forms elastically, so that the cross bar 14b' engages the latching projection 22' to lock the electric connector. The complete locking detecting finger 24' bends up as the cross bar 14b' climbs up the latching projection 22'. Upon the locking engagement of the cross bar 14b' and the projection 24a', the projection 24a' is released from the cross bar 14b', so that the complete locking detecting slider S' is allowed to advance further from a position shown in FIG. 11e to a complete locking indicating position shown in FIG. 11f.

The nose 24b ' of the complete locking detecting finger 24' may be omitted.

Fifth Embodiment

Figure 13:
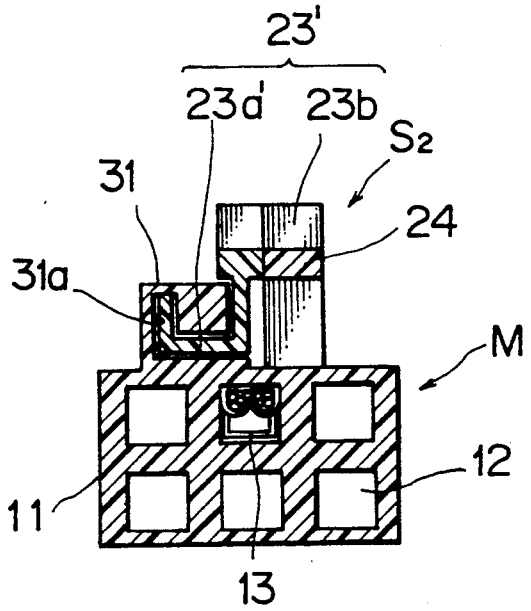
FIG. 13 is a sectional view taken on line XIII—XIII in FIG. 12.
Figure 12:
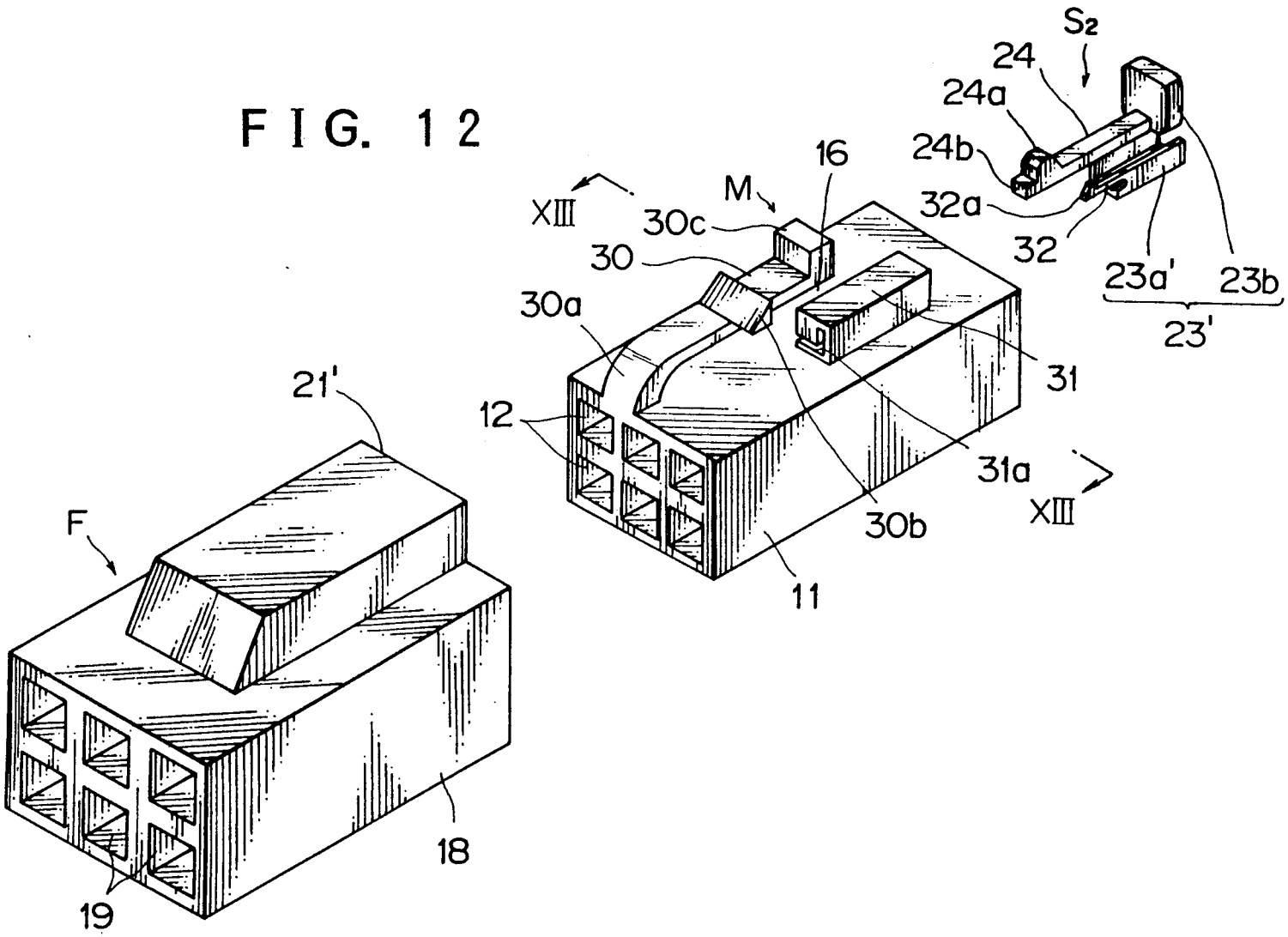
FIG. 12 is an exploded perspective view of an electric connector incorporating a complete locking confirming device in a fifth embodiment according to the present invention.

An electric connector incorporating a complete locking confirming device in a fifth embodiment according to the present invention will be described hereinafter with reference to FIGS. 12 to 14.

The electric connector has a female connector F, which is substantially the same as the female connector F in the second embodiment, and a male connector M provided with a locking finger 30 extending to the rear from the front end of the upper wall of the male connector M and having a base portion 30a merging into the front end of the upper wall of the male connector M. The locking finger 30 is provided in its middle portion with a projection 30b and at its extremity with a knob 30c. A portion of the projection 30b projects from the locking arm 30 on one side of the same.

A complete locking detecting slider $S_2$ consists of a complete locking detecting finger 24, an operating plate 23b formed at the rear end of the complete locking detecting finger 24, and a sliding plate 23a ' having the shape of a channel. A stopping finger 32 provided with a hook 32a at its extremity is extended from the front end of the outer side wall of the sliding plate 23a'. The complete locking detecting finger 24 is provided at its front end with a projection 24a and a nose 24b extending beyond the projection 24a. A slider guide 31 for guiding the sliding plate 23a ' for longitudinal sliding movement is formed beside the locking finger 30. A guide way 16 for guiding the complete locking detecting finger 24 is defined by the locking finger 30 and the slider guide 31. An L-shaped guide groove 31a is formed in the slider guide 31 to receive the outer and bottom walls of the sliding plate 23a'.

The locking action of the electric connector will be described hereinafter with reference to FIGS. 14a to 14c.

Figure 14A:
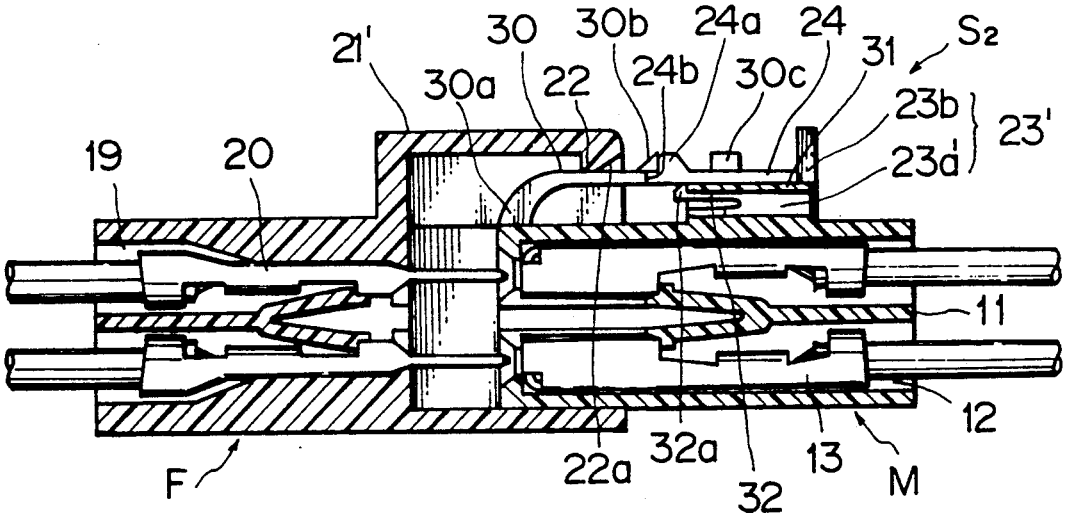
FIGS. 14a, 14b, 14c are sectional views of an essential portion of the electric connector of FIG. 12 in different stages of connection.

In FIG. 14a, the male connector M mounted with the complete locking detecting slider $S_2$ is half fitted in the female connector F, with the sliding plate 23a inserted in the guide groove 31a of the slider guide 31, the complete locking detecting finger 30 extending along the guide way 16, the projection 24a in abutment with the projection 30b of the locking finger 30 and the nose 24b extending beneath the projection 30b , and the hook 32a of the stopping finger 32 engaging the front surface of the slider guide 31.

Figure 14B:
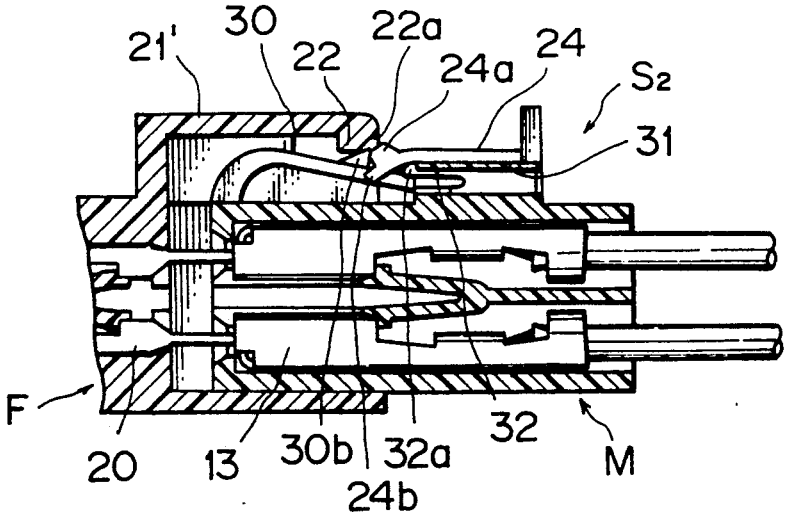

When the male connector M is pushed further into the female connector F from a position shown in FIG. 14a to a position shown in FIG. 14b , the projection 30b of the locking finger 30 slides along the inclined guide surface 22a of the latching projection 22 of the locking chamber 21', bending down the locking finger 30 and the complete locking detecting finger 24.

Figure 14C:
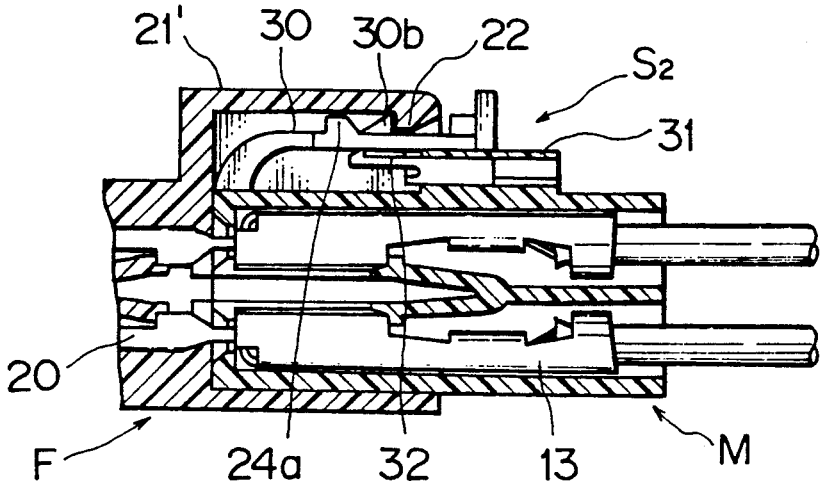
Figure 15:
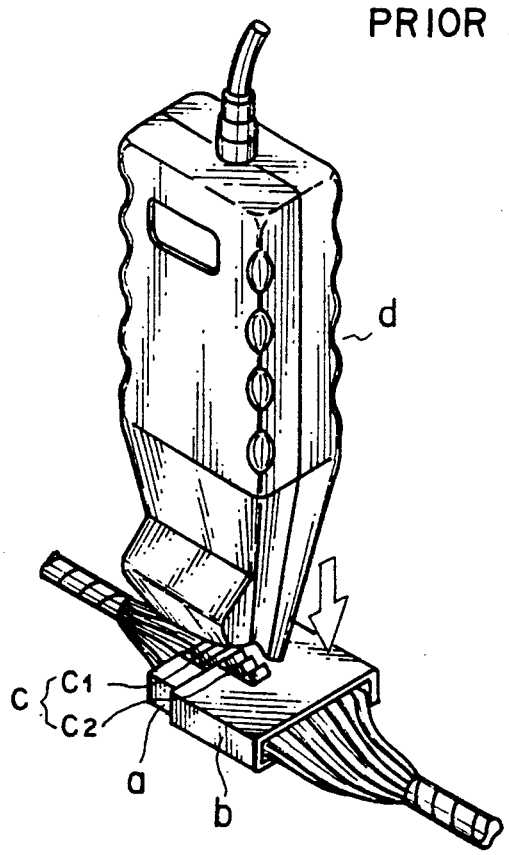
FIG. 15 PRIOR ART
FIG. 15 is a perspective view of an electric connector provided with a conventional complete locking confirming device.
Figure 16:
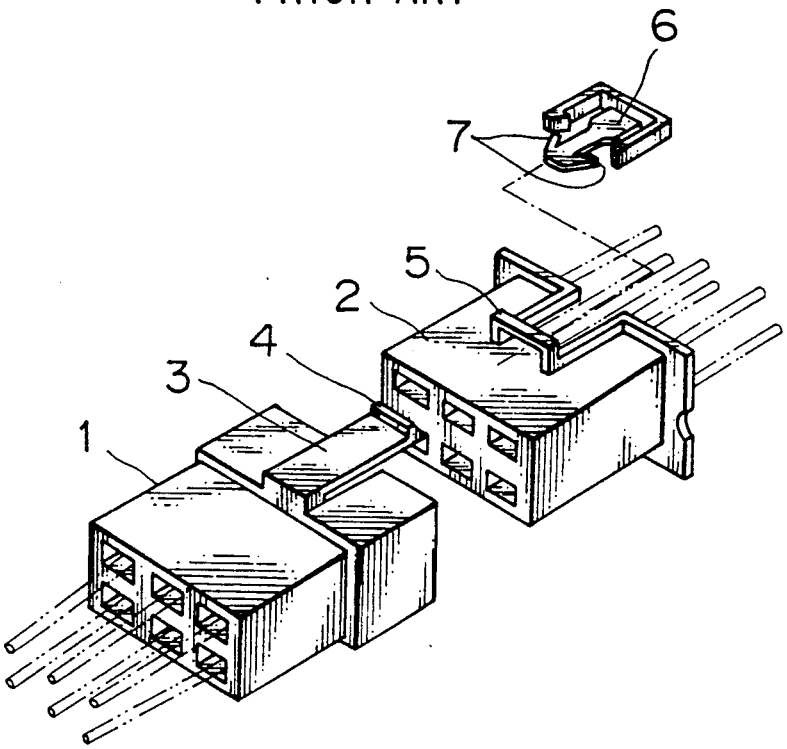
FIG. 16 PRIOR ART
FIG. 16 is an exploded perspective view of an electric connector provided with another conventional complete locking confirming device.
Figure 17:
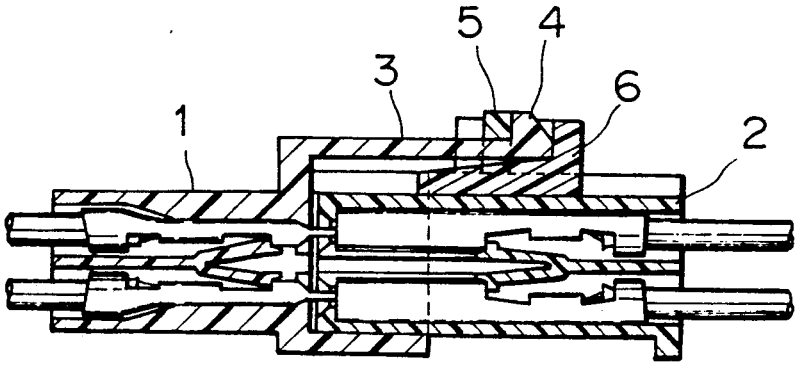
FIG. 17 PRIOR ART
FIG. 17 is a sectional view of an essential portion of the electric connector of FIG. 16 in a connected state.

When the male connector M is pushed further into the female connector F from the position shown in FIG. 14b to a position shown in FIG. 14c, to couple the female connector F and the male connector M completely, the projection 30b of the locking finger 30 passes under the latching projection 22 and engages the inner surface of the latching projection 22 to lock the electric connector, and the complete locking detecting slider $S_2$ is allowed to move to its complete locking indicating position. Thus, the complete locking detecting slider $S_2$ is allowed to be positioned at the complete locking indicating position only when the male connector M and the female connector F are coupled completely and the electric connector is locked.

As is apparent from the foregoing description, according to the present invention, the complete locking detecting slider is allowed to be positioned at the complete locking indicating position only when the male and female connectors of the electric connector are coupled completely and the electric connector is locked, so that the complete locking of the electric connector can surely be confirmed from the position of the complete locking detecting slider.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A complete locking confirming device for an electric connector which comprises a first connector having a housing, a second connector having a housing, a pair of parallel elastically bending locking fingers formed on one end of the outer surface of the wall of the first connector housing so as to define a guide way therebetween, and a latching projection formed on the second connector housing to engage locking projections to lock the electric connector when the first and second connector housings are coupled completely, said complete locking confirming device comprising:

a locking projection provided on each of said locking fingers at its free end for engaging said latching projection;

a complete locking detector slider mounted on the first connector housing for axial sliding movement relative to the housing, and consisting of a slider body having formed thereon a complete locking detecting finger provided at its extremity with a stopping projection, said slider body being guided for sliding movement along the guide way;

sliding advancement of the complete locking detecting slider to a complete locking indicating position being blocked by abutment of the stopping projection of the complete locking detecting finger on the locking projections of the locking fingers of the first connector housing when the locking fingers are not in their locking position;

said stopping projection of the complete locking detecting finger being released from the locking projections of the locking fingers to allow the complete locking detecting slider to advance to the complete locking indicating position when the locking fingers are moved to their locking positions such that the locking projections of the locking fingers engage the latching projection.

2. A complete locking confirming device for an electric connector, according to claim 1, wherein the guide way is defined by the locking fingers and the first connector housing.

3. A complete locking confirming device for an electric connector, according to claim 1, wherein retaining means for retaining the complete locking detecting slider on the first connector housing when the complete locking detecting slider is mounted on the first connector housing with the stopping projection of the complete locking detecting finger in abutment on the locking projections of the locking fingers is provided in combination with the slider body and the first connector housing.

4. A complete locking confirming device for an electric connector, according to claim 1, wherein guide projections are formed on the outer surface of the wall of the first connector housing, guide grooves are formed in the complete locking detecting slider so as to engage the guide projections, respectively, to guide the complete locking detecting slider for sliding movement along the guide projections.

5. A complete locking confirming device for an electric connector, according to claim 1, wherein the complete locking detecting finger of said complete locking detecting slider is provided at its extremity with a nose extending beyond the stopping projection so as to engage the locking projections of the locking fingers.

6. A complete locking confirming device for an electric connector, according to claim 1, wherein a slider holder provided with a guide groove is formed on the outer surface of the first connector housing beside the locking finger with a passage for the complete locking confirming slider therebetween, and a slider plate portion of said complete locking detecting slider engages the guide groove of the slider holder so that the complete locking detecting slider is able to slide along the guide groove of the slider holder.

7. A complete locking confirming device for an electric connector according to claim 1 wherein said complete locking detecting slider is mounted so as to be position at a complete locking indication position only when the first and second connector housings are coupled completely, and wherein said complete locking detecting slider is provided with a complete locking indicating mark at said complete locking indicating position so as to be adjacent a mark reader at said complete locking indicating position to be read thereby.

* * * * *